United States Patent [19]

Bartolac

[11] 4,297,564

[45] Oct. 27, 1981

[54] HAIR DRYER

[76] Inventor: Robert R. Bartolac, 560 Calle La Roda, Camarillo, Calif. 93010

[21] Appl. No.: 964,721

[22] Filed: Nov. 29, 1978

[51] Int. Cl.[3] ..... A45D 20/12

[52] U.S. Cl. ..... 219/367; 219/370; 34/96

[58] Field of Search ..... 219/367-371, 219/373-383; 34/96-100; 134/7, 9, 11, 12; D28/13; 165/103, 126

[56] References Cited

U.S. PATENT DOCUMENTS

| | | | |
|---|---|---|---|
| D. 240,969 | 8/1976 | Fahnstrom et al. | D28/13 |
| 1,339,510 | 5/1920 | Hoffman | 219/373 |
| 1,998,159 | 4/1935 | Johnson et al. | 34/100 |
| 3,272,966 | 9/1966 | Sutton | 34/96 |
| 3,674,980 | 7/1972 | Cox | 219/367 |
| 3,943,329 | 3/1976 | Hlavac | 219/370 |

FOREIGN PATENT DOCUMENTS

| | | | |
|---|---|---|---|
| 493258 | 10/1938 | United Kingdom | 219/373 |

*Primary Examiner*—E. A. Goldberg
*Assistant Examiner*—Bernard Roskoski
*Attorney, Agent, or Firm*—Jack C. Munro

[57] ABSTRACT

A hair dryer which is to include a separate cold air outlet as well as the conventional hot air outlet. A baffle is mounted in conjunction with the cold air outlet and is matingly movable to close the cold air outlet or permit such to be opened.

4 Claims, 4 Drawing Figures

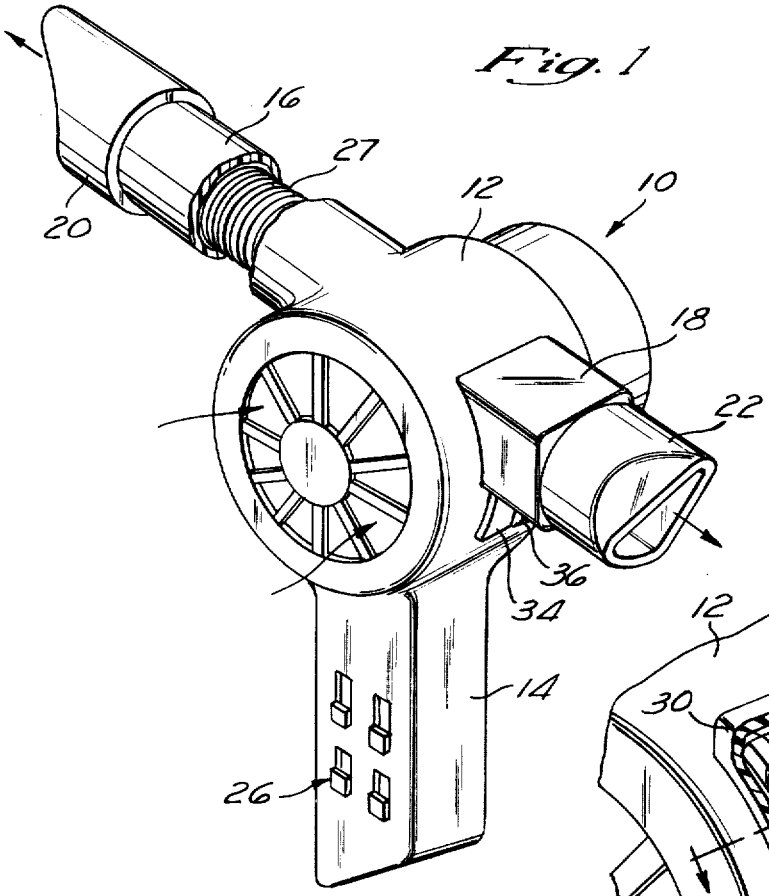
Fig. 1
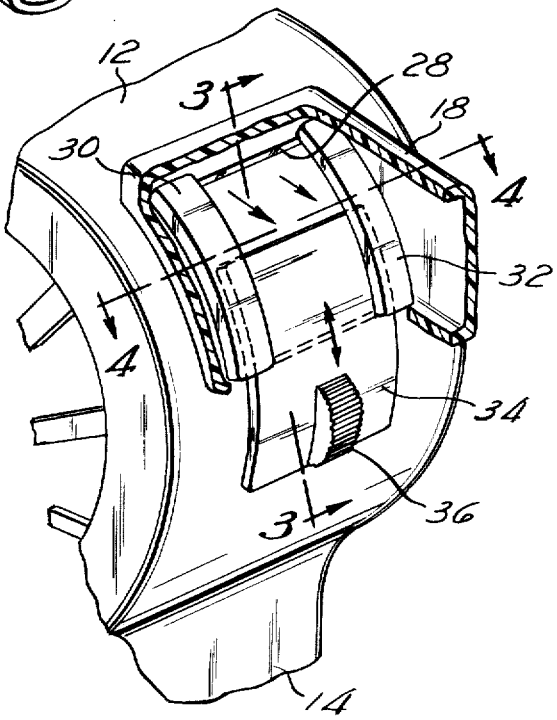
Fig. 3
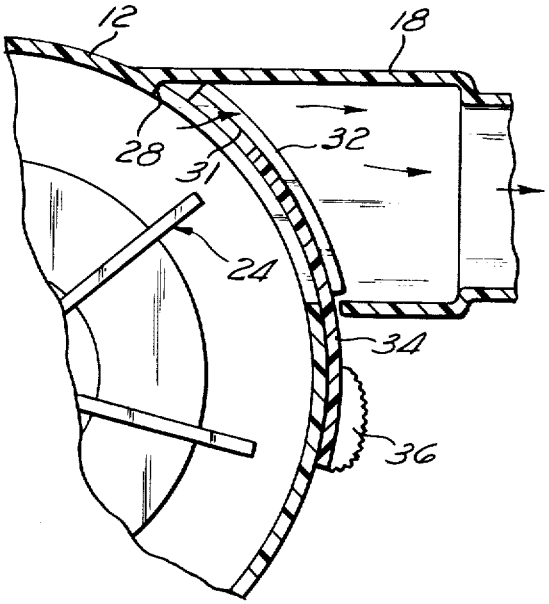
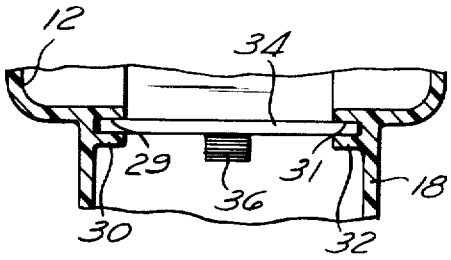
Fig. 4

HAIR DRYER

BACKGROUND OF THE INVENTION

Hot air dryers or blowers are in extremely common use to achieve the drying and setting of hair. In hair salons, the stylists use the hot air in conjunction with a styling brush to have the hair to form into a particular shape such as an enlarged curl or wave. The heat from the blower permits the hair to be formed into its particular desired shape.

Once the particular desired shape is achieved, the normal practice has been for the operator to remove the styling brush and permit the hair to then cool. The thus styled hair will then be in its established shape. However, this permitting the hair to cool is time consuming as a stylist has a substantial number of curls or waves within a single head of hair. If the cooling of the wave could be accomplished quickly, the amount of time spent with each customer by the stylist could be significantly shortened.

Since the stylist employs the use of a hot air blow dryer, if that blow dryer could be modified to include some provision for emitting of cool air, then the same apparatus could be employed by the stylist to both heat the hair and both cool the hair very quickly.

SUMMARY OF THE INVENTION

The structure of this invention relates to the modifying of a conventional air blower or dryer wherein there is an electrically operated fan mounted within the housing. The housing includes a handle which is to be readily grasped by the stylist. One side of the housing includes a hot air outlet and formed within the opposite side of the housing is a cool air outlet. The fan within the dryer under normal operation is to be capable of pushing air through both the hot air outlet and the cold air outlet. A baffle is employed in conjunction with the cold air outlet to either close or open the cold air outlet. The stylist can move the baffle to the closed position during the time the stylist is heating the person's hair thereby getting maximum volume of air being conducted through the hot air outlet. When the stylist wishes to cool the hair, the stylist only need to move the baffle to a position which opens the cold air outlet and turn the housing around so as to subject the cold air to the desired hair area.

The primary objective of this invention is to include within a conventional blow dryer a cold air outlet in conjunction with the conventional hot air outlet and the operator or stylist, by turning around of the blow dryer housing, can either direct hot air or cold air onto a particular hair area.

BRIEF DESCRIPTION OF THE DRAWING

FIG. 1 is an isometric view of the blow dryer constructed in accordance with this invention;

FIG. 2 is an enlarged segmental view, partially in cross section, of the cold air outlet portion of the hair dryer of this invention showing the slidable baffle employed in conjunction with the cold air outlet;

FIG. 3 is a cross-sectional view through the cold air outlet of the blow dryer of this invention taken along line 3—3 of FIG. 2; and FIG. 4 is a cross-sectional view taken along line 4—4 of FIG. 2.

DETAILED DESCRIPTION OF THE SHOWN EMBODIMENT

Referring particularly to the drawing there is shown in FIG. 1 a blow dryer 10 of this invention which includes a blow dryer housing 12, an integrally attached handle 14, a hot air outlet mozzle 16 and a cold air outlet nozzle 18. The nozzles 16 and 18 are both tubular members which are integrally formed in conjunction with the housing 12. The location of the nozzles 16 and 18 are opposite to each other so that the direction of the air emitted from the nozzle 16 is opposite that of the air emitted from the nozzle 18. The nozzles 16 and 18 can optionally include some form of air direction attachment such as is shown at 20 and 22. These attachments 20 and 22 are deemed to be conventional and form no specific part of this invention.

It is further to be understood that located within the housing 12 is an electrically operated fan assembly which is to rotate a blade assembly 24. The rotation of the blade assembly 24 within the interior of the housing 12 functions to create a flow of air. The operation of the blade assembly 24 is to be selectable through the use of a switch assembly 26. It is to be understood that the switch assembly 26 will also control the operation of the heating element 27 which is located within the hot air outlet 16.

It is to be noted that the handle 14 is located with respect to the housing 12 so as to be positioned intermediate or in between the outlets 16 and 18. This is so that during use of the dryer 10, the stylist can readily make a quick turning motion and therefore can quickly change to direct cold air onto the customer's hair when just a moment before the stylist was directing hot air onto the customer's hair.

Integrally formed within the housing 12 and adjacent the cold air opening 28 of the cold air outlet tube 18 are a pair of spaced apart guide members 30 and 32. There is a slightly arcuate groove 29 and 31 formed respectively within each of the guide members 30 and 32. Slidably mounted within each of the grooves 29 and 31 of the guide members 30 and 32 is a slightly arcuately shaped plate or baffle 34. The baffle 34 includes a raised protuberance 36 which is to be readily contactable by the operator or stylist's thumb.

In the operation of the hair dryer 10 of this invention, the stylist or operator will grasp the handle 14 and operate the hair dryer in the normal manner through the use of the buttom assembly 26 to produce a high heat level or low heat level of air being conducted through the air outlet nozzle 16. In this particular operating procedure, the operator will normally have the baffle 34 located in a position to block the opening 28 thereby not permitting the conducting of air through the second air nozzle 18.

I claim:

1. In combination with a hand held, portable hair dryer, said hair dryer having a housing, a motor operated fan mounted within said housing capable of moving air, said housing including a graspable handle, said graspable handle being readily capable of being held within one hand of the operator and said housing to be easily reversibly positioned, said handle including electric switch means to operate said motor operated fan;

a first air outlet formed within said housing, an air heating element located within said first air outlet, air moved by said fan to be conducted through said first air outlet and discharged into the ambient, said first air outlet to discharge air in a first direction, the improvement comprising:

a second air outlet formed within said housing, said second air outlet also to receive air from said fan and conduct such into the ambient, the location of said second air outlet being spaced from said first air outlet, said second air outlet to discharge air in a second direction substantially opposite to said first direction, said second air outlet being void of an air heating device so as to discharge only cool air; and means to close off said second air outlet, said means being manually movable between a closed position and an open position, said closed position not permitting conducting of air through said second air outlet and permitting the total volume of air moved by said motor operated fan to be discharged through said first air outlet, said open position permitting conducting of air through said second air outlet resulting in the dividing of the airflow between said first air outlet and said second air outlet.

2. The hair dryer as defined in claim 1 wherein:

said first direction being substantially opposite to said second direction.

3. The hair dryer as defined in claim 2 wherein:

said graspable handle being located intermediate said first air outlet and said second air outlet.

4. The hair dryer as defined in claim 3 wherein:

said means to close off said second air outlet comprises a baffle member which is capable of movement across said second air outlet to close such, said baffle member being slidably movable within a pair of spaced apart guide members.

* * * * *